US008647155B2

(12) United States Patent
Hung

(10) Patent No.: US 8,647,155 B2
(45) Date of Patent: Feb. 11, 2014

(54) ELECTRICAL-CONDUCTIVE ASSEMBLY FOR SIGNAL CABLE

(75) Inventor: Jen-Yuan Hung, New Taipei (TW)

(73) Assignee: Amphenol LTW Technology Co., Ltd., New Taipei (TW)

( * ) Notice: Subject to any disclaimer, the term of this patent is extended or adjusted under 35 U.S.C. 154(b) by 0 days.

(21) Appl. No.: 13/481,422

(22) Filed: May 25, 2012

(65) Prior Publication Data

US 2013/0316600 A1 Nov. 28, 2013

(51) Int. Cl.
*H01R 9/03* (2006.01)

(52) U.S. Cl.
USPC ..... 439/658; 439/881

(58) Field of Classification Search
USPC ..... 439/658, 881, 868, 421, 423, 580
See application file for complete search history.

(56) References Cited

U.S. PATENT DOCUMENTS 2,802,194 A * 8/1957 Kirk ..... 439/868
2,908,887 A * 10/1959 Broske ..... 439/868
3,310,773 A * 3/1967 Baenziger et al. ..... 439/881
4,721,471 A * 1/1988 Mueller ..... 439/78
6,189,769 B1 * 2/2001 Kuo ..... 228/205
7,115,006 B2 * 10/2006 Onuma ..... 439/881
7,438,610 B2 * 10/2008 Machado et al. ..... 439/881

* cited by examiner

*Primary Examiner* — Hien Vu
(74) *Attorney, Agent, or Firm* — Chun-Ming Shih; HDLS IPR Services

(57) ABSTRACT

An electrical-conductive assembly for a signal cable. The signal cable includes an outer insulation cover and a plurality of cores inside the outer insulation cover. Each core has a protective sheath and an electric wire located in the protective sheath. The electrical-conductive assembly includes an electrical-conductive portion and an electrical-conductive portion member. The electrical-conductive portion is provided on a section of the signal cable with a portion of the outer insulation cover removed. Each core inside the electrical-conductive portion is formed with a naked lead section by removing a portion of the protective sheath. The electrical-conductive member is assembled with the electrical-conductive portion and includes at least one electrical-conductive covering piece electrically connected to the naked lead section and at least one electrical-conductive post extending from the electrical-conductive covering piece.

5 Claims, 5 Drawing Sheets

ELECTRICAL-CONDUCTIVE ASSEMBLY FOR SIGNAL CABLE

BACKGROUND OF THE INVENTION

1. Field of the Invention

The present invention relates to an electrical-conductive assembly, and in particular to an electrical-conductive assembly for a signal cable.

2. Description of Prior Art

With the advance of science and technology, more and more signals have to be transmitted via a signal cable. At least one connecting line is connected to the signal cable, so that the signals can be transmitted by the connecting line from the signal cable to a desired location. According to the existing level of this art, the signal cable has to be cut. One end of the cut signal cable is connected to one end of the connecting line via terminal elements. Then, the terminal elements are inserted into a terminal trough of a connector, so that the signal cable can be electrically connected to the connecting line. The other end of the connecting line is inserted into an electronic device. By means of the connector, the signals from the signal cable can be transmitted to the connecting line and finally transmitted to the electronic device.

However, signal cores inside the signal cable are not electrically connected to cores of the connecting line. Instead, the electrical connection between the signal cable and the connecting line is achieved by the terminal elements and the terminal trough of the connector, which inevitably generates signal attenuation and increased impendence. Thus, the manufacturers in this field attempt to propose a connector which is capable of reducing the signal attenuation. However, such an improvement is restricted because a certain degree of signal attenuation is inevitably generated as long as the signal cable is cut and an additional connector is provided.

On the other hand, the number of the cores in the signal cable may be odd or even. Further, the conventional terminal element has two connecting ends. Thus, when the number of the cores is odd, one of the connecting ends of the terminal element will be unconnected to thereby protrude outside the signal cable. As a result, the external appearance of the signal cable is affected, and leakage of electricity or signal attenuation may be still happened.

Therefore, the present Inventor aims to solve the above-mentioned problems.

SUMMARY OF THE INVENTION

The present invention is to provide an electrical-conductive assembly for a signal cable, which is capable of reducing signal attenuation and suitable for various kinds of signal cables.

The present invention provides an electrical-conductive assembly for a signal cable, the signal cable comprising an outer insulation cover and a plurality of cores inside the outer insulation cover, each core having a protective sheath and an electric wire located in the protective sheath, the electrical-conductive assembly including:

an electrical-conductive portion, provided on a section of the signal cable with a portion of the outer insulation cover removed, each core inside the electrical-conductive portion being formed with a naked lead section by removing a portion of the protective sheath; and an electrical-conductive member, assembled with the electrical-conductive portion, the electrical-conductive member comprising at least one electrical-conductive covering piece electrically connected to the naked lead section and at least one electrical-conductive post extending from the electrical-conductive covering piece.

In comparison with prior art, the present invention has the following advantageous features:

According to the present invention, the signal cable is provided with an electrical-conductive portion. On the electrical-conductive portion, a portion of the outer insulation cover is removed. Each core inside the electrical-conductive portion is formed with a naked lead section by removing a portion of the protective sheath. The electrical-conductive member is made of metallic materials and assembled with the electrical-conductive portion. Especially, the electrical-conductive covering piece in the electrical-conductive member is electrically connected to the naked lead section. Thus, the electrical-conductive member is electrically connected to the naked lead directly rather than via the terminal elements and the terminal troughs as in prior art. In this way, signal attenuation and impedance in the signal cable can be reduced.

On the other hand, since the electrical-conductive member comprises at least one electrical-conductive covering piece electrically connected to the naked lead section and at least one electrical-conductive post extending from the electrical-conductive covering piece, the relationship between the electrical-conductive covering piece and the electrical-conductive post may be embodied as "one-to-one", "one-to-two", "one-to-multiple", "two-to-one", or "multiple-to-one". Therefore, the present invention is suitable for various signal cables having different number of cores.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
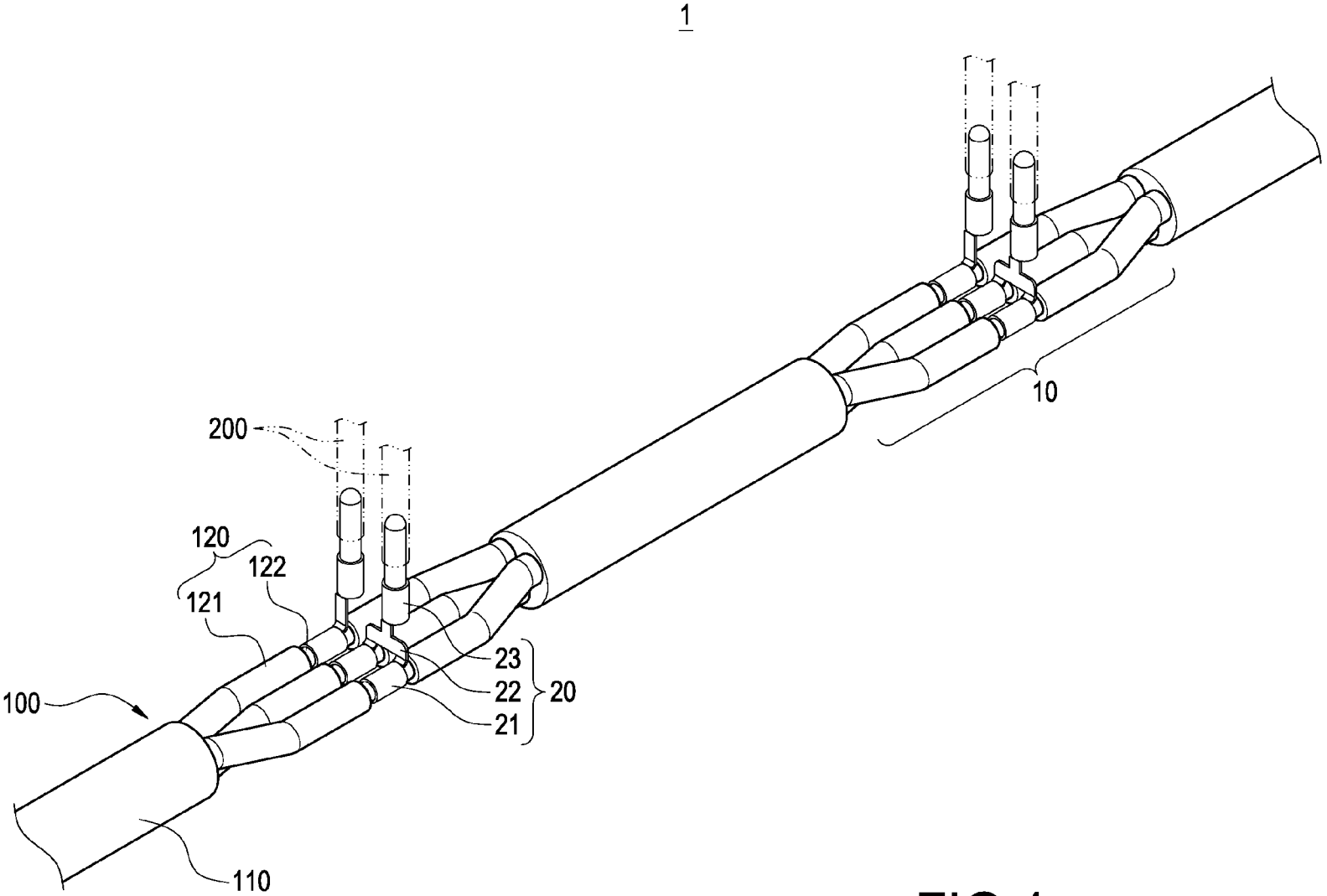
FIG. 1 is a schematic view showing the operation of the present invention.

Please refer to FIG. 1. The present invention provides an electrical-conductive assembly 1 for a signal cable, which is used for electrically connecting a signal cable 100 to a plurality of connecting lines (indicated by dash lines). The signal cable 100 comprises an outer insulation cover 110 and a plurality of cores 120 (three in the present embodiment) located in the outer insulation cover 110. Each core 120 has a protective sheath 121 and an electrical wire 122 located in the protective sheath 121.

The electrical-conductive assembly 1 of present invention includes an electrical-conductive portion 10 and an electrical-conductive member 20.

The electrical-conductive portion 10 is provided on a section of the signal cable 100 with a portion of the outer insulation cover 110 removed. Each core 120 inside the electrical-conductive portion 10 is formed with a naked lead section 122 by removing a portion of the protective sheath 121.

The electrical-conductive member 20 is assembled with the electrical-conductive portion 10. The electrical-conductive member 20 comprises at least one electrical-conductive covering piece 21 electrically connected to the naked lead section 122, a connecting piece 22 extending from the electrical-conductive covering piece 21, and at least one electrical-conductive post 23 connected to the connecting piece 22.

Several aspects of the electrical-conductive member 20 of the present invention will be described with reference to the drawings.

Figure 2:
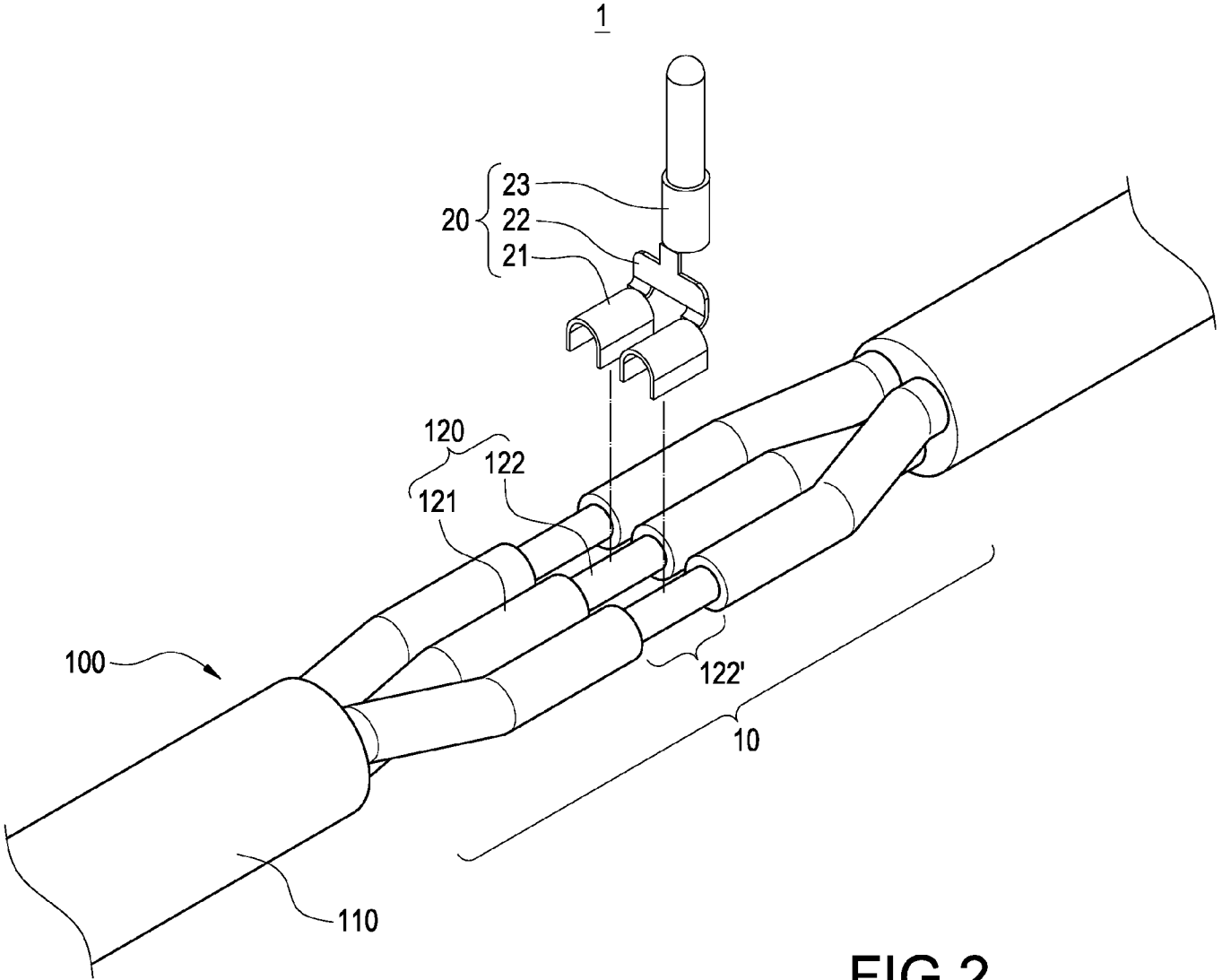
FIG. 2 is an exploded perspective view showing a first aspect of the present invention.
Figure 3:
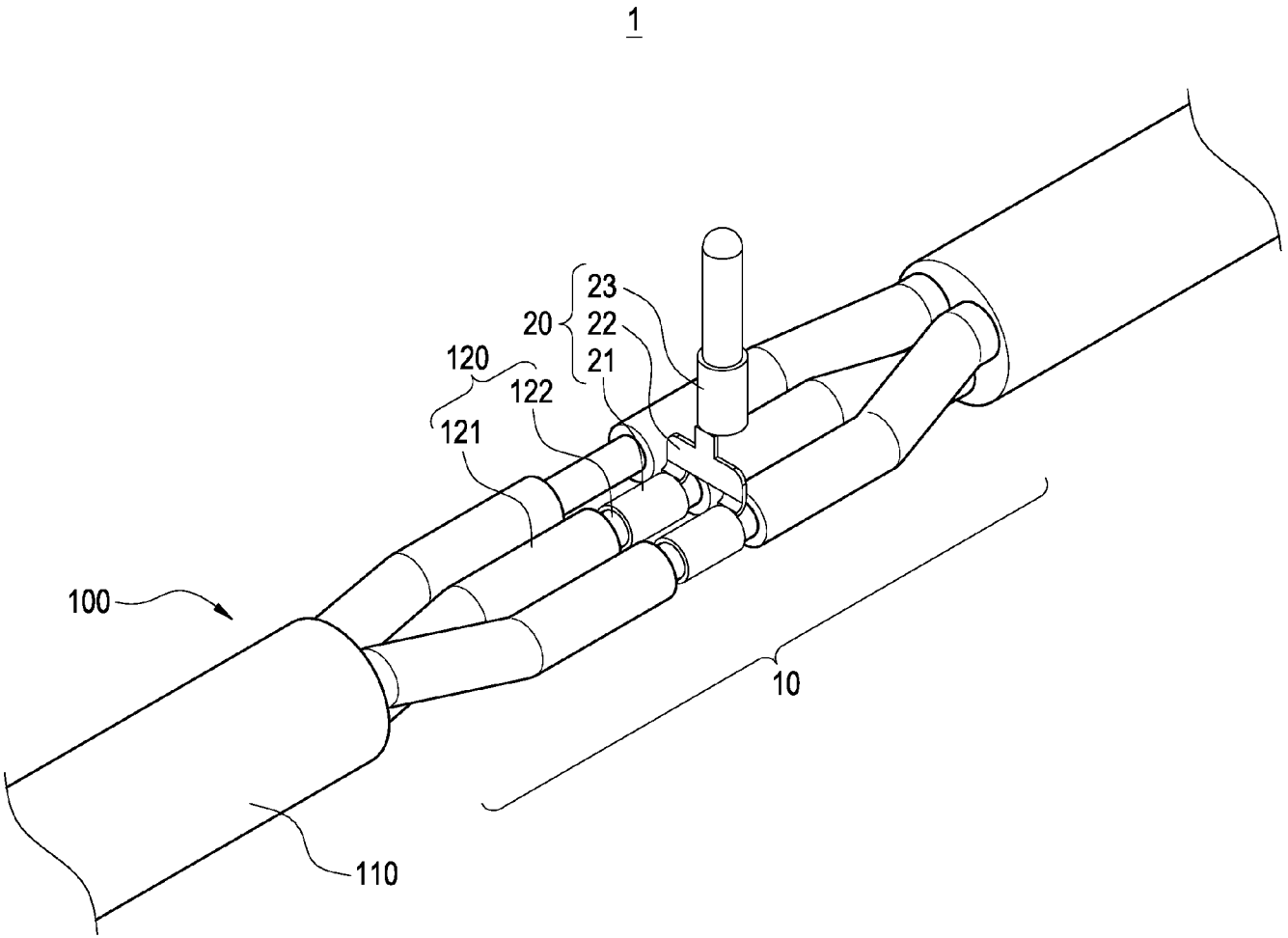
FIG. 3 is an assembled perspective view showing the first aspect of the present invention.

FIGS. 2 and 3 show the first aspect of the electrical-conductive member 20. The electrical-conductive member 20 has two electrical-conductive covering pieces 21 for covering two naked lead sections 122. The electrical-conductive covering pieces 21 may be clamped together by pliers or soldered together, so that the electrical-conductive covering pieces 21 and the naked lead sections 122 can be electrically and firmly connected together. One side of the connecting piece 22 is connected to the two electrical-conductive covering pieces 21. The other side of the connecting piece 22 is connected to the electrical-conductive post 23. The electrical-conductive post 23 is inserted into a connecting line 200 shown in the dashed lines of the FIG. 1.

Figure 4:
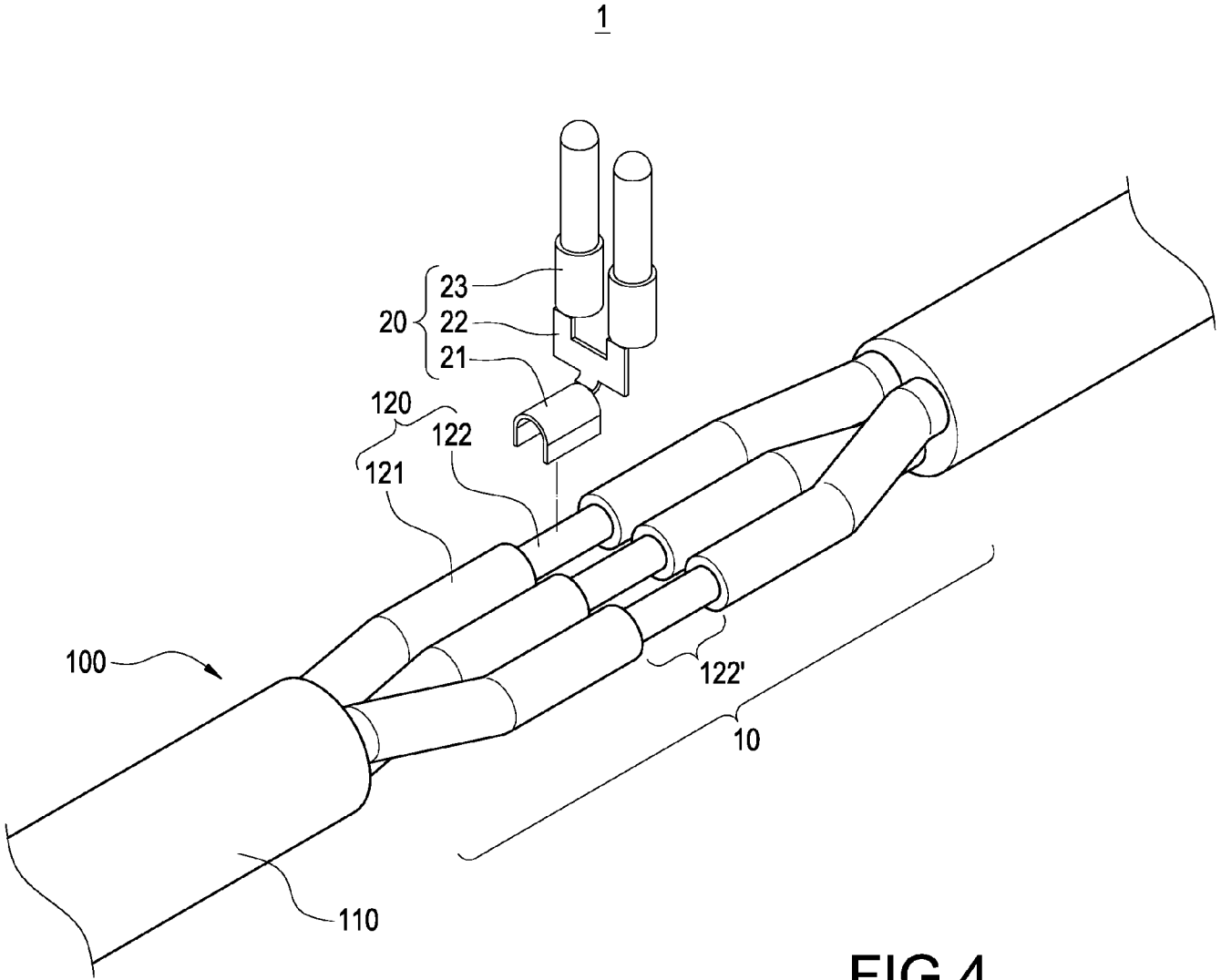
FIG. 4 is an exploded perspective view showing a second aspect of the present invention.
Figure 5:
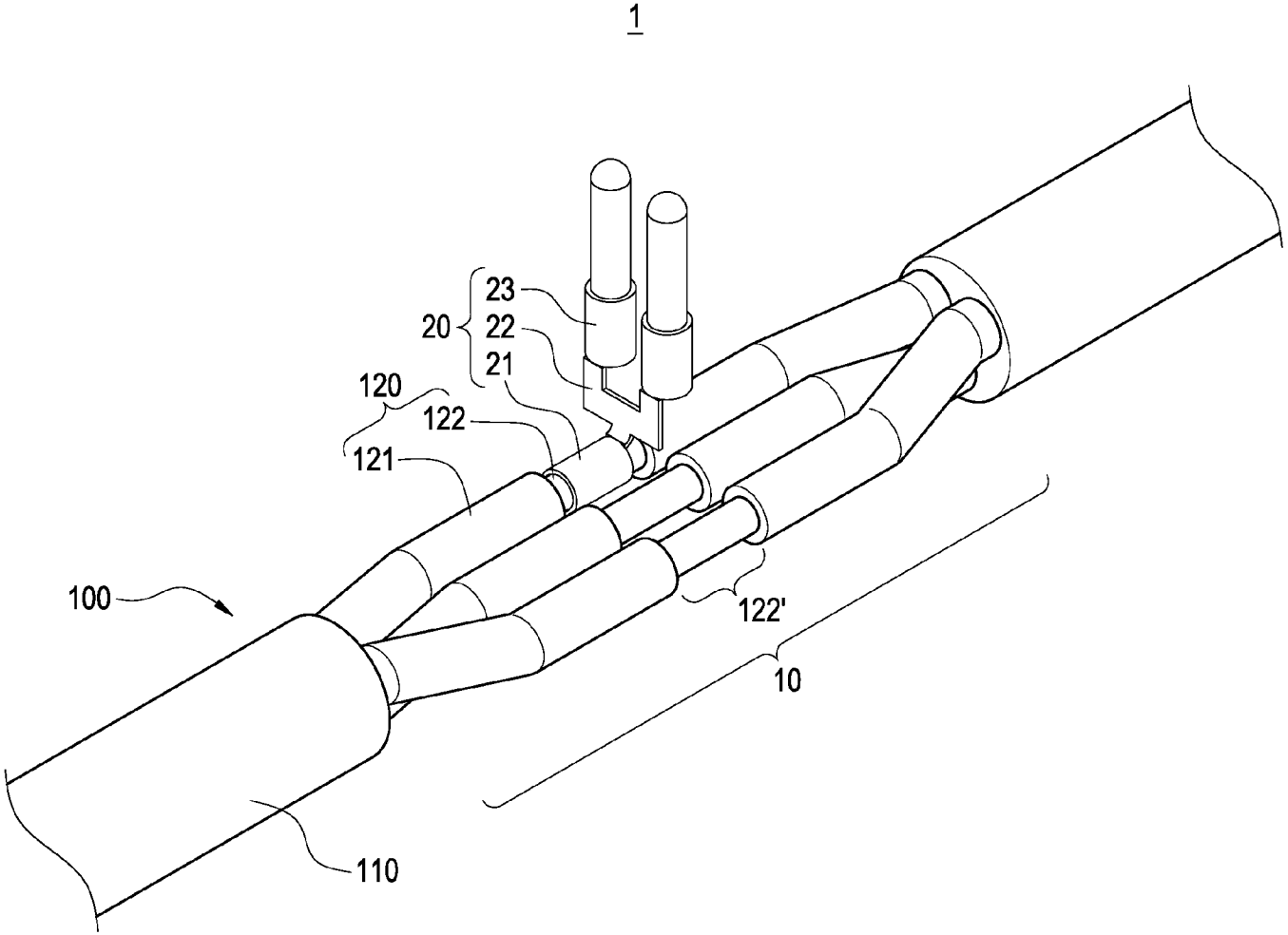
FIG. 5 is an assembled perspective view showing the second aspect of the present invention.

FIGS. 4 and 5 show the second aspect of the electrical-conductive member 20. The electrical-conductive member 20 has an electrical-conductive covering piece 21 for covering a naked lead section 122. One side of the connecting piece 22 is connected to the electrical-conductive covering piece 21. The other side of the connecting piece 22 is connected to the two electrical-conductive posts 23. In other words, the relationship between the electrical-conductive covering piece 21 and the electrical-conductive post 23 may be embodied as "one-to-one", "one-to-two", "one-to-multiple", "two-to-one", or "multiple-to-one". Therefore, the present invention is suitable for various signal cables 100 having different number of cores 120.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An electrical-conductive assembly for a signal cable, the signal cable comprising an outer insulation cover and a plurality of cores inside the outer insulation cover, each core having a protective sheath and an electric wire located in the protective sheath, the electrical-conductive assembly including:

an electrical-conductive portion, provided on a section of the signal cable with a portion of the outer insulation cover removed, each core inside the electrical-conductive portion being formed with a naked lead section by removing a portion of the protective sheath;

an electrical-conductive member attached to the electrical-conductive portion, the electrical-conductive member comprising at least one electrical-conductive covering piece electrically connected to one of the naked lead sections and at least one electrical-conductive post extending from the electrical-conductive covering piece; and a connecting line received therein the electrical-conductive post for electrical conducted with the signal cable;

wherein the electrical-conductive member further comprises a connecting piece, the electrical-conductive covering piece and the electrical-conductive post are connected to two opposite sides of the connecting piece respectively.

2. The electrical-conductive assembly for a signal cable according to claim 1, wherein the electrical-conductive covering piece is clamped to the naked lead section by pliers.

3. The electrical-conductive assembly for a signal cable according to claim 1, wherein the electrical-conductive member has a single electrical-conductive covering piece and a single electrical-conductive post.

4. The electrical-conductive assembly for a signal cable according to claim 1, wherein the electrical-conductive member has a single electrical-conductive covering piece and at least two electrical-conductive posts, so at least two connecting lines are connected to a single core through one electrical-conductive member.

5. The electrical-conductive assembly for a signal cable according to claim 1, wherein the electrical-conductive member has at least two electrical-conductive covering pieces and a single electrical-conductive post, so a single connecting line is connected to at least two cores through one electrical-conductive member.

* * * * *